US007272885B2

(12) United States Patent
Hassanzadeh et al.

(10) Patent No.: US 7,272,885 B2
(45) Date of Patent: Sep. 25, 2007

(54) METHOD OF MANUFACTURING SURGE ARRESTOR

(75) Inventors: Mehrdad Hassanzadeh, Bagneres de Bigorre (FR); Frédéric Malpiece, Bagneres de Bigorre (FR); Dominique Mercier, Billere (FR)

(73) Assignee: Alstom, Paris la Defense Cedex (FR)

( * ) Notice: Subject to any disclaimer, the term of this patent is extended or adjusted under 35 U.S.C. 154(b) by 311 days.

(21) Appl. No.: 10/690,829

(22) Filed: Oct. 23, 2003

(65) Prior Publication Data

US 2004/0111867 A1 Jun. 17, 2004

Related U.S. Application Data

(63) Continuation of application No. 09/869,097, filed as application No. PCT/FR00/02930 on Oct. 20, 2000, now abandoned.

(30) Foreign Application Priority Data

Oct. 25, 1999 (FR) ..... 99 13270

(51) Int. Cl.
*H01C 7/02* (2006.01)
*H01C 7/04* (2006.01)

(52) U.S. Cl. ..... 29/612; 29/592.1; 29/613; 29/618; 29/619; 29/620; 338/21; 338/117; 361/103; 361/106; 361/124; 361/126; 361/127; 361/129

(58) Field of Classification Search ..... 29/612, 29/592.1, 613, 618, 619, 620; 338/21, 117; 361/103, 106, 124, 126, 127, 129
See application file for complete search history.

(56) References Cited

U.S. PATENT DOCUMENTS

| | | | | |
|---|---|---|---|---|
| 3,645,784 | A * | 2/1972 | Helgeland et al. | 427/447 |
| 4,100,588 | A * | 7/1978 | Kresge | 361/127 |
| 4,864,456 | A | 9/1989 | Thuillier et al. | |
| 5,003,689 | A | 4/1991 | Doone et al. | |
| 5,050,032 | A | 9/1991 | Thevenet et al. | |
| 5,366,935 | A | 11/1994 | Alim et al. | |
| 5,926,356 | A | 7/1999 | Sakich et al. | |
| 6,185,813 | B1 | 2/2001 | Donnola | |

FOREIGN PATENT DOCUMENTS

| | | |
|---|---|---|
| EP | 0 280 189 A1 | 8/1988 |
| FR | 2 747 500 A1 | 10/1997 |
| WO | WO97/41573 A1 | 11/1997 |

* cited by examiner

*Primary Examiner*—A. Dexter Tugbang
*Assistant Examiner*—Tim Phan
(74) *Attorney, Agent, or Firm*—Sughrue Mion, PLLC

(57) ABSTRACT

The present invention relates to a method of manufacturing surge arrestors, the method including stacking varistors; and forming a coating of composite material on the stack. Between these steps, also included is placing a bead of flexible, adhesive, and dielectric material on the previously formed stack in register with the various interfaces between each pair of adjacent varistors.

18 Claims, 2 Drawing Sheets

METHOD OF MANUFACTURING SURGE ARRESTOR

This is a continuation of U.S. application Ser. No. 09/869,097 filed Aug. 29, 2001 (now abandoned), which is a National Stage Entry under 35 U.S.C. § 371 of International Application No. PCT/FR00/02930, filed on Oct. 20, 2000, the entire disclosure of which is incorporated herein by reference.

BACKGROUND OF THE INVENTION

The present invention relates to the field of surge arrestors.

It applies in particular to arrestors for medium voltage, typically to electricity networks in which the nominal root-mean-square voltage between phases is greater than 1 kilovolt (kV).

Surge arrestors are devices designed to be connected between ground and an electricity line, in particular at medium or high voltage, for the purpose of limiting the amplitude and the duration of voltage surges that appear on the line.

These surges can be due, for example, to atmospheric phenomena, such as lightning, or to induction phenomena in the conductors.

These surges can also be due to switching operations on a line that is live.

Surge arrestors are generally built up as a stack of varistors, and nowadays usually by a stack comprising a plurality of disks based on zinc oxide, whose electrical resistivity is highly non-linear as a function of applied voltage.

More precisely, such varistors pass practically no current so long as the voltage across their terminals is below a conduction threshold, and in contrast, they pass a very high current, that can be as much as several tens of kiloamps (kA) when the voltage applied across their terminals exceeds the above-mentioned conduction threshold.

The number of varistors used in a surge arrestor is such that the operating voltage of the electricity line is below the conduction threshold of the stack of varistors.

Thus, the arrestor can withstand the service voltage continuously and without significant current leakage, while nevertheless making it possible to pass very high levels of discharge current that can appear temporarily on a line in the event of an accidental surge. Numerous types of arrestors have already been proposed.

The arrestor field has given rise to very abundant literature.

At present, known arrestors generally comprise:

- a stack of varistors;
- two contact pieces of electrically conductive material placed at respective ends of the stack of varistors; and
- an envelope of electrically insulating material surrounding the stack of varistors.

The above-mentioned envelope of electrically insulating material is itself the subject of very abundant literature.

For example, document GB-A-2 073 965 proposes making the envelope out of a heat-shrink material.

Documents U.S. Pat. No. 4,298,900, DE-A-3 001 943, and DE-A-3 002 014 has proposed also placing an outer case of porcelain over the heat-shrink envelope.

Documents U.S. Pat. No. 4,092,694 and U.S. Pat. No. 4,100,588 have proposed placing each varistor in a silicone-based ring and placing the stack of varistors surrounded in this way in a case of porcelain.

Document U.S. Pat. No. 2,050,334 proposes placing a stack of varistors in a porcelain case and filling the gap between the case of porcelain and the stack of varistors with a filler material, e.g. formed by a halogenated wax-based compound.

Documents EP-A-0 008 181, EP-A-0 274 674, EP-A-0 231 245, and U.S. Pat. No. 4,456,942 propose making the envelope surrounding the varistors out of an elastomer material, formed in position by overmolding.

More precisely, EP-A-0 274 674 proposes overmolding an envelope out of composite material based on elastomer, ethylene-propylene diane monomer (EPDM), silicone, or some other optionally filled resin, on a stack of varistors.

Document U.S. Pat. No. 4,161,012 also proposes placing an envelope of elastomer on the varistors. That document proposes making the envelope by depositing the elastomer on the outside surface of the varistors, or by molding the envelope on the varistors, or indeed by preforming the elastomer envelope and then inserting the varistors therein.

As early as 1958, Document U.S. Pat. No. 3,018,406 proposed making the envelope in the form of two complementary pre-shaped shells together with an outer envelope of plastics material injection-molded onto the varistors.

Document U.S. Pat. No. 3,586,934 proposes making the envelope out of a synthetic resin, e.g. based on epoxy or polyester, or indeed out of polyester or silicone varnish.

Document EP-A-0 196 370 proposes making the envelope on a body of varistors by casting a synthetic resin, e.g. constituted by epoxy resin, polymer concrete, silicone resin, or elastomer, or by covering the body of varistors in a heat-shrink tube of plastics material, or indeed providing said stack with a layer of synthetic resin.

In addition, documents U.S. Pat. No. 4,656,555, U.S. Pat. No. 4,905,118, U.S. Pat. No. 4,404,614, EP-A-0 304 690, EP-A-0 335 479, EP-A-0 335 480, EP-A-0 397 163, EP-A-0 233 022, EP-A-0 443 286, and DE-A-0 898 603 propose making the envelope surrounding the stack of varistors out of composite materials made up of fibers, generally resin-impregnated glass fibers.

More precisely, document U.S. Pat. No. 4,656,555 proposes initially forming a winding of fibers based on plastics material such as polyethylene, or glass, or indeed ceramic, optionally impregnated in resin, e.g. epoxy, and then forming on the outside of the winding a case of weatherproof polymer material, e.g. a case based on elastomer polymers, synthetic rubber, thermoplastic elastomers, or EPDM.

More precisely, that document proposes either preforming the weatherproofing polymer case and then engaging the stack of varistors fitted with the fiber winding inside the case, or else initially forming the fiber winding on the stack of varistors and then making the case of weatherproofing polymer material by molding it onto the winding, by spraying polymer onto the winding, or by dipping the stack of varistors provided with the winding in a bath of polymer.

Document U.S. Pat. No. 4,404,614 proposes placing in succession on a stack of varistors: a first envelope based on resin-impregnated glass fibers, e.g. impregnated with epoxy resin; then a second envelope based on glass flakes and epoxy resin; and finally an elastic outer envelope based on EPDM rubber or on butyl rubber.

That document states that the first envelope, the second envelope, and the outer envelope can be put into place in succession the stack of varistors, or the envelopes can be made in the opposite order.

That document also mentions the possibility of molding the outer envelope on the second envelope based on glass flakes and epoxy resin.

Document EP-A-0 233 022 proposes forming on a stack of varistors a shell that is based on glass fibers reinforced by epoxy resin, and then an elastomer-based envelope that is heat-shrinkable, or that can be released by equivalent mechanical means onto said shell.

In a variant, the envelope can be molded in situ using a synthetic resin or a polymer material.

The document states that the shell can be preformed. The document also proposes using a sheet of preimpregnated fibers.

Document EP-A-0 304 690 proposes beginning with a filamentary winding of glass fibers impregnated in resin, and then forming a coating on the outside of the winding by injecting an EPDM type elastomer material.

Document EP-A-0 355 479 proposes placing in succession on the stack of varistors, firstly a barrier formed by a plastics film, e.g. based on propylene, then a winding of non-conductive filaments, and finally an elastomer case that is weatherproof.

Document EP-A-0 397 163 proposes placing in succession on the stack of varistors, a winding of resin-impregnated filaments, and then forming a coating of elastomer flakes on said winding, e.g. by injecting EPDM.

The technique of using a composite material is very old.

In 1964, document DE-A-0 898 603 was already proposing to use resin-impregnated glass fibers to envelop varistors.

More recently, document FR-A-2 698 736 has proposed a method of manufacturing an arrestor comprising the steps which consist in stacking varistors, forming a first envelope of composite material on the stack of varistors, which first envelope is at least semi-rigid and presents a constant external section along its length to serve in particular to compensate for surface irregularities of the stack of varistors due to misalignments and to dispersions in varistor dimensions, and then in placing an outer envelope having fins or "sheds" on the first envelope, the outer envelope being made of composite material of substantially constant thickness on the first envelope and then fitting annular fins on the extruded annular envelope.

Furthermore, document WO-A-97/39462 describes a method of manufacturing arrestors comprising the steps which consist in:

stacking varistors; and forming an envelope of composite material on the stack of varistors;

wherein the step of forming an envelope of composite material consists in:

placing a fiber fabric on the outside of the stack of varistors and in contact therewith;

placing a flexible outer envelope on the outside of the stack of varistors; and injecting a material suitable for impregnating the fiber fabric into the annular space formed between the stack of varistors and the flexible outer envelope.

Arrestors that have been proposed so far have provided good service.

Nevertheless, they do not always give full satisfaction.

In particular, the Applicant has observed that nearly all presently-manufactured arrestors are made on the basis of enameled varistors.

Until now it has been considered essential to enamel varistors in order to improve their dielectric strength and also to establish a chemical barrier against their immediate environment.

The Applicant has observed that this enameling gives rise to two problems.

Firstly, the enameling which generally contains a large content of lead (Pb), typically greater than 50%, leads to a major risk of polluting the environment, unless precautions are taken during manufacture for the recovery and/or recycling of used arrestors, which is inevitably expensive.

Secondly, enameling can be performed only prior to stacking, and consequently must be performed individually, varistor by varistor, giving rise to a non-negligible contribution to the overall cost price of present-day arrestors.

Starting from this observation, the Applicant proposes the present invention for improving existing arrestors.

A main object of the present invention is to make reliable arrestors based on varistors but without requiring enameling.

SUMMARY OF THE INVENTION

A subsidiary object of the present invention is to further reduce the cost of known arrestors.

To this end, the present invention provides a method of manufacturing surge arrestors, the method being of the type comprising the steps consisting in:

making a stack of varistors; and forming a coating of composite material on the stack of varistors;

the method being characterized by the fact that:

between the steps of making the stack and forming the coating of composite material, the method includes the step of depositing a bead of flexible, adhesive, and dielectric material on the previously-formed stack in register with the various interfaces between each adjacent pair of varistors.

The present invention also provides arrestors obtained by implementing the above method.

Other characteristics, objects, and advantages of the present invention will appear on reading the following detailed description together with the accompanying drawings, given as non-limiting examples.

BRIEF DESCRIPTION OF THE DRAWINGS

Accompanying

DETAILED DESCRIPTION OF ILLUSTRATIVE NON-LIMITING EMBODIMENTS

Figure 1:
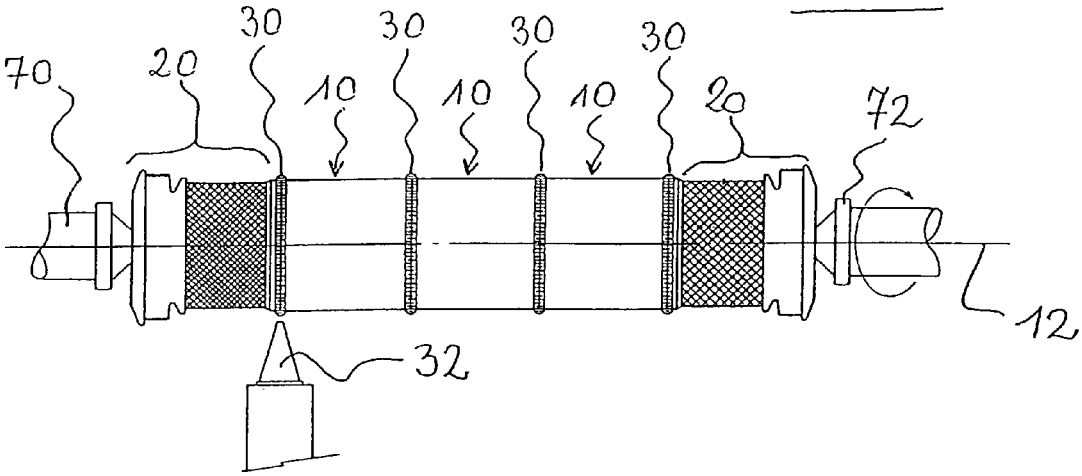
FIGS. 1 to 4 are diagrams showing various successive steps in the manufacture of a surge arrestor constituting a preferred implementation of the present invention.
Figure 2:
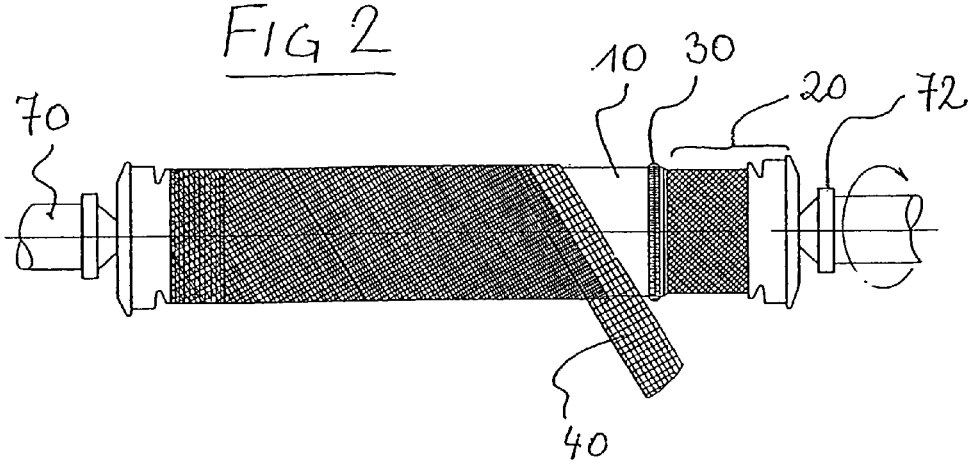
Figure 3:
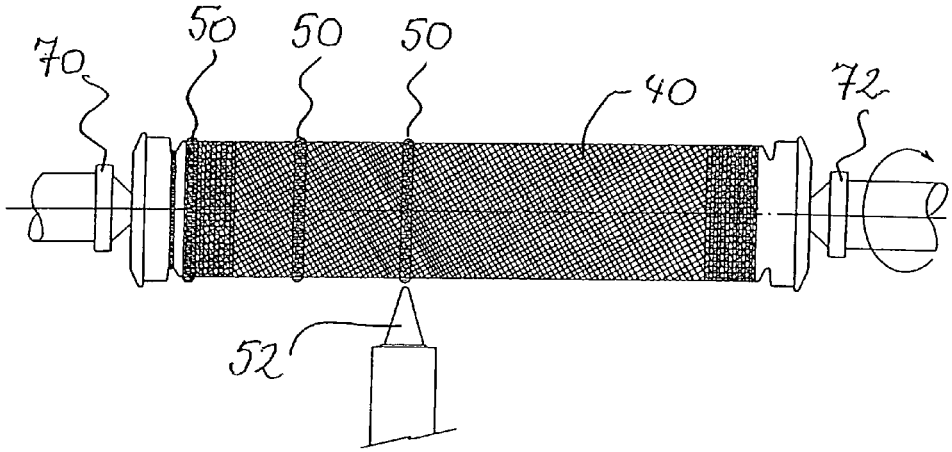
Figure 4:
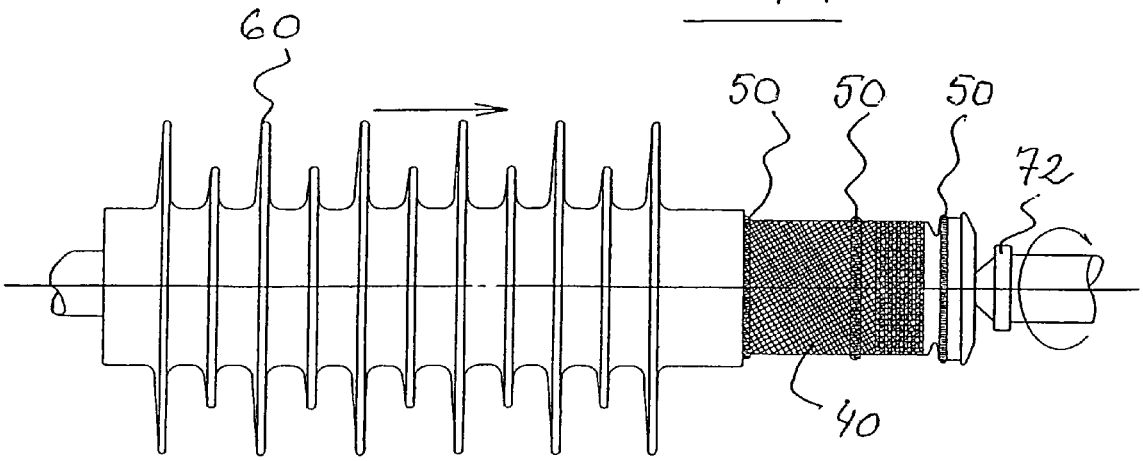

The method of manufacturing surge arrestors as shown in accompanying FIGS. 1 to 4 comprises the steps which consist in:

stacking varistors 10 to touch each other so as to be centered on a common axis 12 (possibly with spacers being interposed between at least some adjacent pairs of varistors 10), with electrically-conductive electrode-forming pieces, referred to herein as "centering pieces" 20, being placed at respective ends of the stack, and then keeping the assembly under axial compression;

placing annular beads 30 of an adhesive/sealing agent on the resulting stack in register with each interface defined at the junction between two adjacent varistors 10 (see FIG. 1);

helically winding a preimpregnated woven tape (preferably based on glass fibers and epoxy resin or the equivalent) around the assembly, typically with an overlap of 50% and doing so in a single pass so as to obtain the equivalent of two thicknesses of preimpregnated woven tape over all parts of the stack (as shown in FIG. 2 where the preimpregnated woven tape is referenced 40);

placing beads 50 of an adhesive/sealing agent at regular intervals on the previously taped assembly (as shown in FIG. 3);

expanding an outer envelope of elastomer 60 (typically based on a silicone rubber or the equivalent) and engaging it on the above-coated body (as shown in FIG. 4); and then baking the assembly to ensure that the internal composite material 40 polymerizes.

Naturally, the invention is not limited to the number or dimensions of varistors shown in the accompanying figures.

The adhesive/sealing agent 30 placed on the interfaces of the stack of varistors 10 is a material which is flexible, adhesive, and dielectric. It is advantageously constituted by an elastomer or a gel, e.g. based on silicone or the equivalent.

In a preferred embodiment of the present invention, the varistors 10 are non-enameled varistors.

In the context of the present invention, it is possible to use non-enameled varistors 10 because the specific material 30 is added at the peripheral junction between the varistors 10, said material serving both to guarantee good dielectric strength against shocks (adhesive function) and total absence of axial partial discharge (sealing function).

However, in a variant, the varistors 10 could have a thin protective film of enamel for protecting the varistors during the process of manufacturing the arrestor, in particular to ensure that the varistors are not polluted during the arrestor manufacturing process.

Conventional enamel layers typically possesses thickness of about 100 micrometers (μm). Such a protective film in accordance with the present invention can typically possess a thickness that is one-half to one-third the conventional thickness.

In the context of the present invention, the protective film can be removable, i.e. it can be withdrawn once the risk of pollution has disappeared during the manufacturing process.

Furthermore, in the context of the present invention, the protective film is made of a lead-free material.

More precisely, it should be observed that the beads of material 30 are preferably made of a material based on silicone mastic, making it possible:

ensure that there are no bubbles or pockets of air between the stack of varistors 10 and the subsequent winding 40; the beads 30 serve, so to speak, to compensate for any defects at the edges of the varistors; the beads 30 of silicone mastic thus advantageously replace conventional enameling at the interfaces between adjacent pairs of varistors;

to avoid any penetration of epoxy resin from the composite material 40 wound on the stack of varistors into the interfaces between adjacent pairs of varistors (the Applicant has observed in particular that if epoxy resin is not prevented from penetrating between the varistors 10, then when the arrestor is passing a current, the resulting electrodynamic force tending to separate adjacent varistors 10 leads to the surface layers being torn from the varistors at the interfaces because of the strong adhesion between said surface layers of the varistors and the epoxy resin that has penetrated between them); and to provide good adhesion between the stack of varistors 10 and the composite coating 40 superposed thereon by means of the elastic bonding provided by the beads 30, both with the outer surface of the varistors 10 and with the superposed coating 40.

Typically, in the context of the present invention, each bead 30 of silicone mastic has an axial width of about 5 millimeters (mm) and thickness that is comparable, and preferably less than 5 mm.

The beads 30 are preferably deposited in the form of single turns of single-component silicone mastic, which must necessarily be compatible with the material of the varistors 10 which are themselves most advantageously based on zinc oxide. For this purpose, it is preferable for the material 30 to include no acetic acid.

As shown diagrammatically in FIG. 1, the annular beads 30 are preferably deposited by using a plurality of suitable nozzles that are spaced apart or by using a dispenser nozzle 32 that does not rotate but that can be moved axially in cyclical manner with a step-size equal to the distance between two beads 30, and by rotating the stack of varistors 10 and the end centering pieces 20 about the axis 12 while maintaining the stack under axial compression.

In FIG. 1, the parts for keeping the stack under axial compression and also for rotating it are referenced 70 and 72.

In a preferred but non-limiting implementation of the present invention, the material constituting the beads 30 is a silicone mastic sold by Dow Corning under the reference 7091. This silicone mastic has excellent adhesion without using a primary and a neutral polymerization base. This silicone mastic can be used over a temperature range of −55° C. to +150° C., and it presents elongation of 500% and dielectric strength of 16 kV per mm.

The tape 40 of preimpregnated fabric is preferably wound at 45° with 50% overlap, and its resin content preferably lies in the range one-third to one-half by weight.

In a preferred but non-limiting implementation of the invention, the tape of preimpregnated fabric 40 is constituted by a fabric whose resin content is about 35% with a nominal weight of 450 grams per square meter (g/m$^2$) and a reinforcing structure based on glass fibers having nominal weight of 305 g/m$^2$ using a satin 8 type structure.

It should be observed that such a tape 40 is self-extinguishing.

The adhesive/sealing agent forming the beads 50 formed on the composite tape 40 can be made of the same material, preferably silicone mastic or the equivalent, as that used for making the above-described beads 30.

The material 50 is preferably selected to as to have duplicating, adhesive, dielectric, and filling properties so as to make it easier to engage the outer envelope 60, so as to adhere strongly thereto, so as to provide dielectric functions, and so as to fill properly the interface between the composite coating 40 and the outer envelope 60.

The material 50 deposited on the composite coating 40 can optionally be placed helically. However, and as shown in FIG. 3, it is preferable for the material 50 to be deposited in the form of annular beads.

In this case also, the material 50 is preferably deposited using a plurality of nozzles, or a nozzle 32 that does not rotate but that can be moved cyclically in the axial direction with a step-size equal to the distance between two beads 50, with the preformed arrestor assembly being caused to rotate about the axis 12.

It should also be observed that such beads 50 are preferably deposited at both ends of the stack so as to ensure that all surface irregularities between the composite tape 40 and the outer envelope 60 are filled completely over the entire length of the arrestor, and so as to guarantee that the arrestor is properly sealed.

As shown diagrammatically in FIG. 4, the elastomer outer envelope 60 is preferably an envelope having external annular fins or "sheds" serving to lengthen the creepage distance over the outside of the arrestor. The number of fins and also their shapes and spacing can vary as a function of requirements concerning ability to withstand pollution, and naturally also as a function of the nominal voltage of the arrestor.

It would be observed that such an outer envelope 60 fitted with annular fins is characterized by zones of greater stiffness in register with the fins.

The use of the outer envelope 60 as a mold for shaping the body of the arrestor by radial compression during the step of polymerizing the resin of the preimpregnated tape 40 ensures proper adhesion between the various layers of the internal material and also serves to guarantee good sealing and the absence of partial discharges in the radial direction of the device.

In the present invention, this polymerization step is preferably performed under axial compression at a temperature of about 130° C. and for a duration of about 1 hour (h).

The arrestor obtained by implementing the above method comprises:

- a stack of varistors 10 that are preferably made of zinc oxide and not enameled (or are coated only in a fine film of enamel that is lead-free and therefore not polluting, and that is used solely to facilitate the varistor manufacturing process), optionally associated with one or more intermediate metal spacers;
- a contact metal electrode 20 at each end;
- a composite coating 40 obtained by a single helical winding of a tape of glass fiber fabric preimpregnated with synthetic resin;
- an outer envelope 60 of elastomer; and
- an adhesive agent 30 at the junction interfaces between the varistors 10 and the composite coating 40, and an adhesive agent 50 at the interfaces between the composite coating 40 and the elastomer envelope 60.

Naturally, the present invention is not limited to the particular embodiment described above and extends to all variants within its spirit.

Thus, in a variant, the tape 40 of glass fiber fabric preimpregnated with synthetic resin can be placed on the stack of varistors 10 carrying the silicone mastic beads 30, not in the form of a helical winding, but in the form of rings placed in register with respective interfaces between each pair of adjacent varistors. In which case, in order to ensure that the arrestor has satisfactory dielectric behavior, the resulting assembly is preferably also provided with an outer envelope that presents good dielectric behavior, e.g. based on overmolded silicone, or indeed an envelope put into place by being expanded and then shrunk, or else a heat-shrink envelope.

In yet another variant embodiment of the present invention, the tape 40 of preimpregnated fabric can be deposited in the form both of rings in register with the bonding interfaces between adjacent pairs of varistors, and of a superposed helical winding as shown in FIG. 2.

The invention claimed is:

1. A method of manufacturing surge arrestors, the method comprising the steps of:

making a stack of varistors such that the varistors touch each other; and forming a coating of composite material on the stack of varistors;

wherein, between the steps of making the stack and forming the coating of composite material, the method includes the step of depositing individual beads of flexible, adhesive, and dielectric material on the previously-formed stack at interfaces between each adjacent pair of varistors where the varistors touch each other, such that the individual beads are spaced apart from each other in an axial direction of the stack.

2. The method according to claim 1, wherein the beads of flexible, adhesive, and dielectric material are made of at least one of an elastomer, a gel, and a silicone material.

3. The method according to claim 1, wherein the material constituting the beads is adapted to eliminate all pockets of air from the interfaces between each adjacent pair of varistors, to prevent material penetrating into said interfaces, and to provide elastic bonding between the stack of varistors and the coating of composite material.

4. The method according to claim 1, wherein each bead has a typical width of 5 mm and a thickness of less than 5 mm.

5. The method according to claim 1, wherein the material constituting the beads has no acetic acid.

6. The method according to claim 1, further comprising the steps of depositing an outer envelope on the coating of composite material and using said outer envelope as a mold for shaping the body of the arrestor by a radial compression effect during a polymerization step.

7. The method according to claim 6, wherein the outer envelope possesses annular fins.

8. The method according to claim 6, further comprising the step of depositing beads of adhesive/sealing agent on the coating of composite material prior to installing the outer envelope.

9. The method according to claim 8, wherein the beads of adhesive/sealing agent deposited on the coating of composite material are made of silicone mastic.

10. The method according to claim 8, wherein the beads of adhesive/sealing agent deposited on the coating of composite material are shaped as rings.

11. The method according to claim 1, wherein the coating of composite material is wound helically.

12. The method according to claim 1, wherein the coating of composite material is made by helically winding a preimpregnated woven tape with overlap of 50%.

13. The method according to claim 1, wherein the coating of composite material has rings of preimpregnated woven tape deposited in register with the interfaces between adjacent pairs of varistors.

14. The method according to claim 13, wherein the arrestor also has an envelope deposited on the coating of composite material to reinforce dielectric behavior of the arrestor.

15. The method according to claim 1, wherein the coating of composite material based on glass fibers and epoxy resin, has a resin content lying in the range one-third to one-half by weight.

16. The method according to claim 1, wherein the coating of composite material is made under axial compression of the stack of varistors.

17. The method according to claim 1, wherein the varistors are not enameled.

18. The method according to claim 1, wherein the varistors are coated in a fine protective film of a lead-free enamel.

* * * * *